United States Patent [19]

Wilwerding

[11] 3,993,928

[45] Nov. 23, 1976

[54] EXTENDED RANGE CORRECT EXPOSURE ANNUNCIATOR

[75] Inventor: Dennis J. Wilwerding, Littleton, Colo.

[73] Assignee: Honeywell Inc., Minneapolis, Minn.

[22] Filed: Dec. 19, 1975

[21] Appl. No.: 642,281

[52] U.S. Cl. ..... 315/241 P; 315/134; 315/135; 315/151; 354/33; 354/128

[51] Int. Cl.[2] ..... H05B 41/32

[58] Field of Search ..... 315/241 P, 151, 157, 315/159, 129, 134, 135; 354/32, 33, 35, 127, 128, 145

[56] References Cited

UNITED STATES PATENTS

| | | | |
|---|---|---|---|
| 3,706,911 | 12/1972 | Wilwerding | 315/158 |
| 3,809,954 | 5/1974 | Engelstatter | 315/241 P |
| 3,814,985 | 6/1974 | Pecher et al. | 315/241 P |
| 3,914,647 | 10/1975 | Broekstra et al. | 315/151 X |

*Primary Examiner*—Eugene LaRoche
*Attorney, Agent, or Firm*—David R. Fairbairn

[57] ABSTRACT

An electronic flash apparatus includes a correct exposure annunciator which operates if light received from the subject exceeds a predetermined percentage of the required illumination.

20 Claims, 12 Drawing Figures

EXTENDED RANGE CORRECT EXPOSURE ANNUNCIATOR

REFERENCE TO CO-PENDING APPLICATIONS

Subject matter disclosed but not claimed in this application is disclosed in and claimed in co-pending applications by Dennis J. Wilwerding, entitled "Remote Sensor for Electronic Flash Units", and by John D. Dick and Dennis J. Wilwerding, entitled "Automatic Exposure Indicator", which were filed on even date herewith and assigned to the same assignee.

BACKGROUND OF THE INVENTION

The present invention relates to automatic electronic or "computer" flash systems. In particular, the present invention relates to electronic flash systems having an improved performance correct exposure annunciator.

Automatic electronic flash systems include a light producing means, generally a flash tube, which is actuated to illuminate a scene being photographed. A light sensing or exposure control circuit detects the scene illumination and actuates a light terminating or light quenching means when sufficient light has been produced to properly expose a light sensitive film of an associated camera.

There is a need for an annunciator which indicates to the photographer whether sufficient light has been produced to properly expose the film. Correct exposure annunciators which perform this function in response to a single indicative of correct exposure are described in U.S. Pat. No. 3,706,911 by Dennis J. Wilwerding, and Ser. No. 603,565 by James R. Adams, Jr. and Dennis J. Wildwerding, and Ser. No. 603,564 by James R. Adams, Jr. and in the above mentioned application by John D. Dick and Dennis J. Wilwerding, all of which are assigned to the same assignee as this application.

In the past, correct exposure annunciators have operated in response to a signal which is indicative of premature termination of the light flash by the light terminating means. These correct exposure annunciators, therefore, have not indicated correct exposure if the illumination received by the light sensing or exposure control circuit is only slighly less than the quantity required to cause premature flash termination.

Automatic electronic flash systems typically have an automatic control level which is set to provide "full rated illumination" out to the distance at which "full light flash" occurs. A "full light flash" is a light flash which is not prematurely terminated by the terminating means. Instead, the light flash is terminated because the voltage on the main flash capacitor eventually drops to a level which will no longer support conduction through the flash tube. The terminating means has not operated because the exposure control circuit has not received sufficient light before most of the energy has been dissipated from the main flash capacitor.

Beyond the distance at which a full light flash occurs, the flash illumination drops off as the square of the distance. Acceptable photographs, however, can be obtained with illumination down to one f/stop below the "full rated illumination".

The disadvantage of the previous correct exposure annunciator circuits is that the annunciator only indicates correct exposure when "full rated illumination" is provided. The annunciator does not indicate, however, that an acceptable picture is still possible if the illumination is only slightly less than "full rated illumination". The photographer may not be aware of the fact that the correct exposure annunciator does not indicate all conditions in which acceptable photographs can be obtained.

SUMMARY OF THE INVENTION

In the present invention, improved operation of a correct exposure annunciator is achieved. The annunciator is operated when the light received by the light sensor attains a predetermined percentage of full rated illumination.

DETAILED DESCRIPTION OF THE PREFERRED EMBODIMENTS

Figure 1:
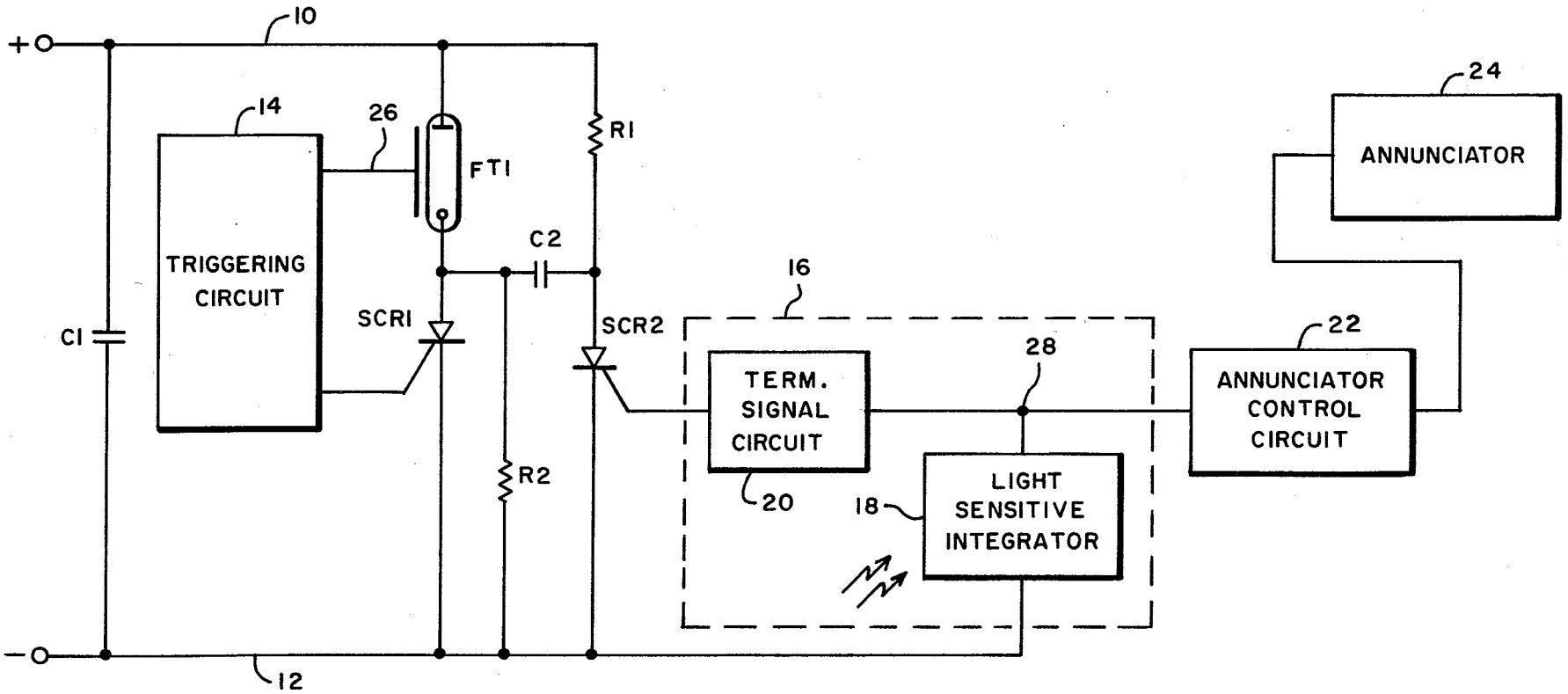
FIG. 1 shows an embodiment of the present invention.

FIG. 1 shows one preferred embodiment of the present invention. The electronic flash apparatus of FIG. 1 includes conductors 10 and 12, which are connected to a positive and negative terminal, respectively. The positive and negative terminals are adapted to be connected to the usual capacitor charging means (not shown) which are used in conjunction with electronic flash apparatus.

The electronic flash apparatus includes a main storage capacitor C1, a flash tube FT1, flash termination switch SCR1, triggering circuit 14, a commutation circuit formed by resistors R1 and R2, capacitor C2, and commutation switch SCR2, an exposure control circuit 16 formed by light sensitive integrator 18 and termination signal circuit 20, annunciator control circuit 22 and annunciator 24.

Triggering circuit 14 may take one of many well known forms. Examples of triggering circuits which may be used are shown in U.S. Pat. No. Re. 28,025 by Murata et al and U.S. Pat. No. 3,809,954 by Engelstatter.

Exposure control circuit 16 receives light from the scene which is illuminated by the flash and produces a termination signal when the total light reaches a predetermined desired value. Exposure control circuit 16 (and light sensitive integrator 18 and termination signal circuit 20) may take many different forms and are preferably of the general type described in U.S. Pat. No. Re. 26,999 by F.P. Elliott and U.S. Pat. No. 3,519,879 by F.T. Ogawa.

Annunciator control circuit 22 is preferably a level detector which produces an annunciator control signal when the signal produced by light sensitive integrator 18 reaches a predetermined value. Annunciator 24 may be an annunciator of the type described in the previously mentioned Wilwerding patent, U.S. Pat. No. 3,706,911, or in any one of the previously mentioned co-pending patent applications.

The operation of the apparatus shown in FIG. 1 is generally as follows. Capacitor C1 is charged to a relatively high voltage by the usual capacitor charging means which are not shown in FIG. 1. Capacitor C1 is a source of energy to the electronic flash apparatus during production of the light flash.

To initiate a flash, the user closes contacts (not shown) which form a part of triggering circuit 14. Triggering circuit 14 produces a triggering signal at triggering terminal 26 of flash tube FT1 and at the gate of SCR1. This triggering signal causes FT1 and SCR1 to turn on, and FT1 begins to produce the light flash.

Once FT1 and SCR1 have been turned on and light is being produced by FT1, light sensitive integrator 18 begins to produce a first or "light integral" signal in response to light reflected from the object being illuminated. This first signal appears at terminal 28 and is sensed by termination signal circuit 20. When the first signal reaches a first predetermined level, termination signal circuit 20 produces a terminating signal which is applied to the gate of SCR2.

The terminating signal turns on commutation switch SCR2, and the voltage across commutation capacitor C2 is applied to anode - cathode of SCR1, thereby reducing the voltage at the anode of SCR1. This reduction in voltage at the anode of SCR1 turns off SCR1, thereby terminating the light flash.

In previous electronic flash apparatus, the correct exposure annunciator only operates if the light flash has been prematurely terminated as a result of sufficient light being received by exposure control circuit 16. The annunciator would not indicate a correct exposure if the first signal was only marginally less than the first predetermined level when the flash was terminated by a reduction in potential across capacitor C1 (i.e. a full light flash).

The apparatus of FIG. 1 overcomes this shortcoming of prior correct exposure annunciator circuits. Annunciator control circuit 22 is also connected to terminal 28 and senses the first signal. Annunciator control circuit 22 produces a second or "annunciator control" signal if the first signal attains a second predetermined level which is a fraction of the first predetermined level. Annunciator 24, therefore, will be operated in some cases when a full light flash has occurred because the first signal indicates that sufficient light was received to obtain an acceptable photograph. The annunciator 24, therefore, provides a more reliable indication of correct exposure than has been previously obtained.

Annunciator control circuit 22 may apply the annunciator control signal to annunciator 24 immediately upon first signal attaining the second predetermined level. Alternatively, annunciator control circuit 24 may delay applying the annunciator control signal until the light flash has been terminated.

Figure 2:
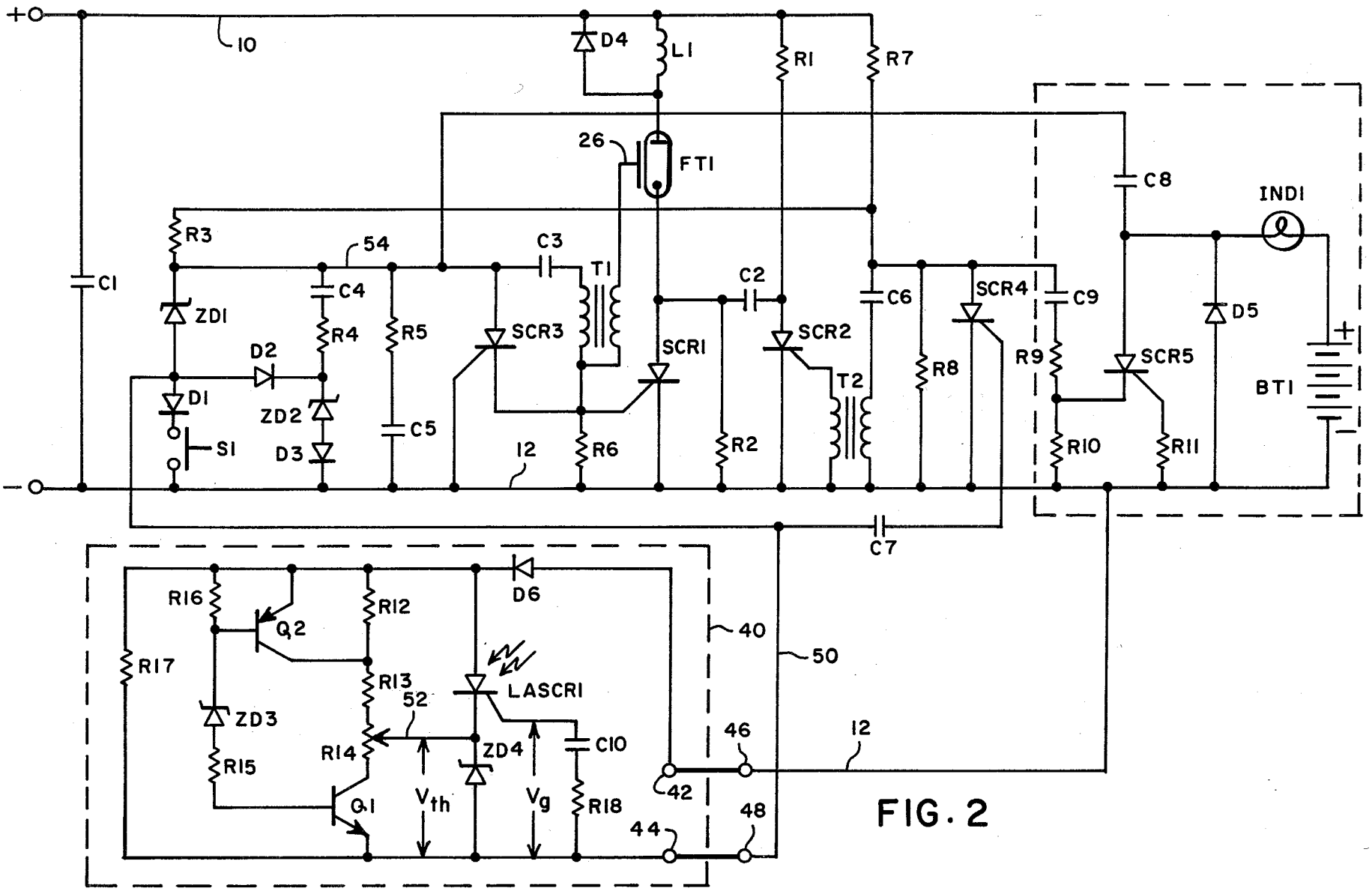
FIG. 2 shows an electronic flash apparatus with a remote light sensor in which the operating characteristics of the correct exposure annunciator are improved.

FIG. 2 shows another embodiment of the present invention. The electronic flash apparatus of FIG. 2 includes a remote sensor 40 which is generally similar to the remote sensor described in U.S. Pat. No. 3,914,647 by B. Broekstra and D.J. Wilwerding. Only a small modification to the remote sensor is necessary to provide extended range of operation for the annunciator.

The electronic flash apparatus of FIG. 2 is generally similar to the apparatus shown in FIG. 1. Similar numerals and letters have been used, therefore, to designate similar elements.

The triggering circuit for triggering flash tube FT1 and termination switch SCR1 includes resistors R3–R7, capacitors C3–C5, diodes D1–D3, zener diodes ZD1 and ZD2, transformer T1, triggering switch SCR3, and contacts S1. Inductor L1 and diode D4 are connected in series with FT1 and SCR1 to modify the current waveform flowing through FT1 and SCR1.

As in FIG. 1, the flash may be terminated prematurely by turning off SCR1. This is achieved by the well known commutation technique. The commutation circuitry includes resistors R1 and R2, commutation capacitor C2, commutation switch SCR2, capacitors C6 and C7, resistor R8, and SCR4.

The correct exposure annunciator shown in FIG. 2 includes battery BT1, indicator lamp IND1, diode D5, capacitors C8 and C9, and resistors R9 and R10, and R11. The annunciator is generally similar to the circuits described in U.S. Pat. No. 3,706,911 by D.J. Wilwerding. The operation of the commutation circuitry and the annunciator circuit is controlled by remote sensor 40. Remote sensor 40 includes two terminals, 42 and 44. These terminals are connected by a cord of other suitable two-wire conductor to terminals 46 and 48 of the flash unit. Terminals 46 and 48 are connected to reference conductor 12 and signal line conductor 50, respectively. The potential at conductor 12 and, therefore, terminal 42, is termed the "reference potential $V_{ref}$". The potential on signal line 50 and, therefore, terminal 44, is termed the "signal line potential $V_{sig}$".

Input terminal 42 is connected through the anode-to-cathode path of diode D6 to the anode of a light activated silicon controlled rectifier, LASCR1. The anode of LASCR1 is also connected through resistors R12, R13, and R14 to the collector of transistor Q1. The emitter of Q1 is connected to terminal 44. The base electrode of Q1 is connected through resistor R15, anode-to-cathode of zener diode ZD3, and resistor R16 to the anode of LASCR1. Resistor R17 is connected between the anode of LASCR1 and terminal 44. Resistor R14 has a slider contact 52 which is connected to the cathode of LASCR1. The cathode of LASCR1 is also connected to terminal 44 through zener diode ZD4. The anode of ZD4 is connected to terminal 44, and the cathode of ZD4 is connected to the cathode of LASCR1. The gate of LASCR1 is connected to terminal 44 through integration capacitor C10 and anticipation resistor R18.

The operation of the flash apparatus of FIG. 2 is generally as follows. Capacitor C4 is initially charged to a voltage determined by ZD1, and capacitors C5 and C3 are charged to a voltage equal to the sum of the zener voltages of ZD1 and ZD2.

To initiate a flash, contacts S1 are closed. The closing of contacts S1 drops the signal line potential to approximately the reference potential. Capacitor C3 discharges through ZD1, D1, S1, SCR3 gate-to-cathode, and the primary winding of T1 to capacitor C3. The time required to turn on SCR3 is rather short and, therfore, C3 does not dissipate much energy until SCR3 turns on. At that time, C3 dumps its charge through SCR3 anodle-to-cathode and into the primary winding of T1. The voltage induced in the secondary winding of T1 is applied to triggering electrode 26 of FT1 to turn FT1 on.

With SCR3 on, a discharge path is established for charge stored in capacitor C5, and it discharges through a current path including R5, SCR3 anode-to-cathode, and SCR1 gate-to-cathode. The time constant of C5 and R5 is selected so that the gate current is maintained on SCR1 until sufficient current is available through flash tube FT1 to keep SCR1 in conduction.

When SCR3 turns on, the potential at conductor 54 is reduced. This causes capacitor C4 to drive signal line 50 negative to a voltage determined by remote sensor 40. This change in signal line potential is hereinafter termed a "first change" in potential. The time constant of C4 and R4 allows C4 to maintain the negative voltage level on signal line 50 and thereby power remote sensor 40 until the flash is completed.

Diode D2 insures that no retriggering can occur until the anode voltage is above the ZD1 voltage level. Diode D3 allows the signal line 50 to drive below ground further than one diode drop. If D3 were not present, ZD2 would become forward biased as soon as C4 began to drive signal line 50 negative with respect to reference line 12. Similarly, diode D1 isolates signal line 50 from switch S1, allowing signal line 50 to be driven negative.

Prior to the initiation of the flash, the signal line potential at terminal 44 of remote sensor 40 is positive with respect to the reference potential at terminal 42. Diode D6 prevents conduction in remote sensor 40 since diode D6 is reverse biased. When a flash is initiated and signal line potential is driven negative with respect to the reference potential, terminal 42 becomes positive with respect to terminal 44. Diode D6 is then forward biased and current is allowed to flow in remote sensor 40. Zener diode ZD3 conducts in the reverse direction, thereby turning on transistor Q1. The current flowing through diode D6 flows through Q2 emitter-to-collector, resistors R13 and R14, and collector-to-emitter of Q1. The voltage established at the anode of LASCR1 effectively powers or enables LASCR1.

When transistor Q1 is turned on, a potential is established at slide wire 52 and is applied to the cathode of LASCR1. This potential is hereinafter termed the "threshold potential $V_{th}$". When LASCR1 is enabled, a current representative of the amount of light received by LASCR1 flows through its gate to integrating capacitor C10 and through anticipation resistor R18. The voltage $V_g$ appearing at the gate of LASCR1 represents a first signal which is formed by the light integral voltage plus the anticipation voltage.

The remote sensor 40 of FIG. 2 is generally similar to the light sensor described in U.S. Pat. No. 3,914,647 by B. Broekstra and D.J. Wilwerding. The components which have been added with the present invention to extend the range of operation of the correct exposure annunciator are resistors R12 and R16, and transistor Q2. The operation of this added annunciator range extending circuitry is as follows.

While the signal line is held negative, Q2 is saturated due to the current flowing through ZD3. Resistors R13 and R14, therefore, form the divider for the threshold voltage $V_{th}$ in the normal state. When the signal line potential $V_{sig}$ begins to collapse after a flash, Q2 turns off due to the lower voltage drop across R16. When Q2 turns off, the threshold voltage divider is then formed by R12, R13, and R14. This effectively reduces the threshold voltage $V_{th}$.

When the voltage $V_g$ at the gate of LASCR1 exceeds a threshold voltage $V_{th}$, and an enabling signal is present across the anode-to-cathode path of LASCR1, LASCR1 becomes conductive. When LASCR1 becomes conductive, a relatively lower resistance path is presented between signal line 50 and reference line 12. The signal line potential $V_{sig}$ exhibits a second change, which is a step change in a positive direction toward the reference potential. This positive step change is coupled through capacitor C7 to the gate of SCR4, thereby turning on SCR4. This, in turn, results in turning on SCR2 and SCR5. When SCR2 is turned on, commutation of SCR1 occurs and SCR1 is turned off. When SCR5 is turned on, indicator lamp IND1 is turned on, thereby indicating correct exposure.

Figure 3A:
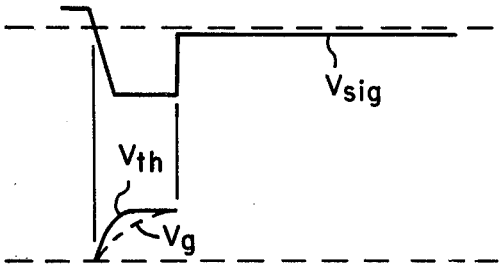
FIGS. 3A – 3C show signal line potential $V_{sig}$, gate potential $V_g$, and threshold potential $V_{th}$ as a function of time for three different levels of illumination received by the remote sensor of FIG. 2.
Figure 3B:
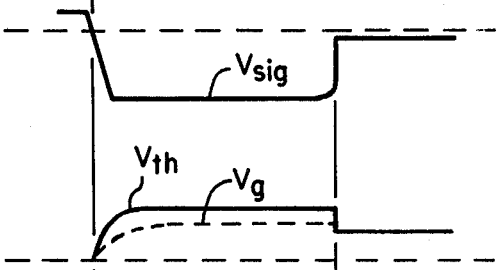
Figure 3C:
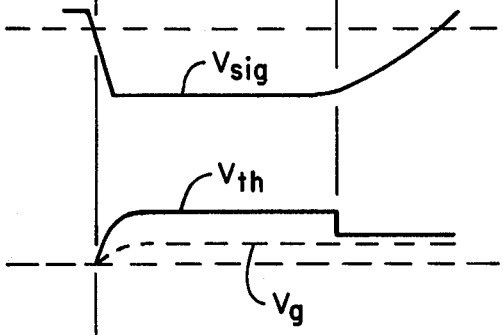
Figure 4:
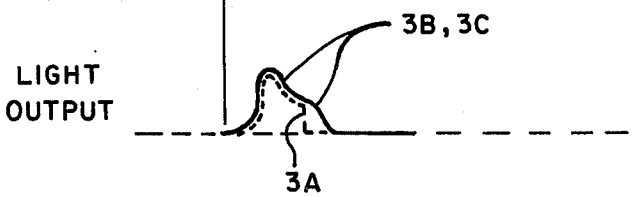
FIG. 4 shows light output as a function of time for the operating conditions shown in FIGS. 3A – 3C.

FIGS. 3A–3C and FIG. 4 illustrate the improved operation of the correct exposure indicator as a result of additional components R12, R16, and Q2. FIG. 3A illustrates a situation in which sufficient light is received to turn on LASCR1 and cause premature termination of the light flash. FIG. 3B illustrates the situation in which insufficient light has been received to terminate the light flash prematurely, but sufficient light has been received to result in an acceptable photograph. FIG. 3C illustrates a situation in which the light received is insufficient both to terminate the light flash prematurely and to result in an adequately exposed photograph. FIG. 4 illustrates light output from the flash tube as a function of time for the three situations shown in FIGS. 3A–3C.

In FIG. 3A, $V_g$ exceeds $V_{th}$ during the light flash interval and causes a step change in the signal line potential. This step change causes termination of the light flash prematurely and the operation of the correct exposure annunciator. The dashed line shown in FIG. 4 illustrates the light output when prematurely terminated as shown in FIG. 3A.

FIG. 3B illustrates a condition in which $V_g$ was insufficient to cause flash termination but was greater than 50 percent of $V_{th}$. In this case, when $V_{th}$ is reduced to 50 percent of its normal value by the turning off of Q2, $V_g$ suddenly exceeds $V_{th}$ and LASCR1 is turned on. This causes this signal line to collapse suddenly. This step change in signal line voltage $V_{sig}$ fires SCR4 and results in operation of the correct exposure annunciator.

FIG. 3C illustrates a condition in which $V_g$ is less than 50 percent of $V_{th}$. Even when $V_{th}$ is reduced to 50 percent of its normal value, $V_g$ is still insufficient to trigger LASCR1. As a result, no signal is sent to the flash unit, and the correct exposure annunciator does not operate.

The improved flash apparatus of the present invention has several advantages. First, it provides extended and more accurate operation of the correct exposure annunciator. Second, it achieves this improved performance with a minimum of additional components. Third, the additional components may be added solely to the remote sensor. Improved performance may be obtained, therefore, by merely using an improved remote sensor with an existing flash unit. No modification of the annunciator circuit itself is necessary. Fourth, no separate calibration of the second predetermined level (which causes operation of the correct exposure annunciator) is required. The second predetermined level is fixed by selection of the values of resistors R12, R13, and R14. Fifth, although a 50 percent level has been described for the second predetermined level, it can, of course, be any different value desired depending upon the values of R12, R13, and R14.

Figure 5:
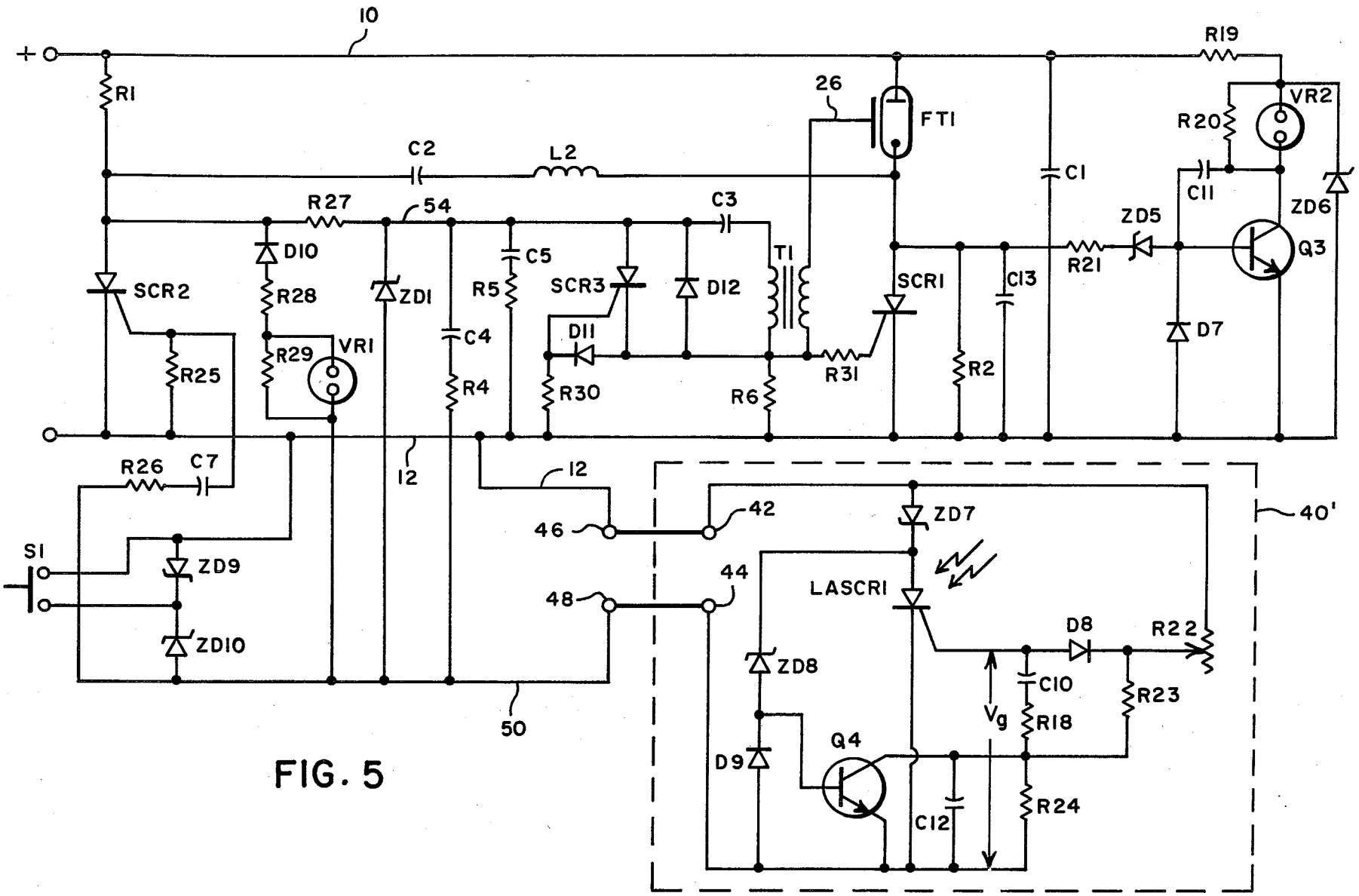
FIG. 5 shows another embodiment of electronic flash apparatus with improved correct exposure annuciator operating characteristics.

FIG. 5 illustrates another embodiment of the present invention. The flash apparatus of FIG. 5 is generally similar to the apparatus of FIG. 2, and similar letters and numerals have been used to designate similar components.

The operation of the apparatus of FIG. 5 is described in the co-pending patent applications Ser. No. 642,282 by Dennis J. Wilwerding entitled "Remote Light Sensor For Electronic Flash Units" and Ser. No. 642,283 by John D. Dick and Dennis J. Wilwerding entitled "Automatic Exposure Annunciator", which were filed on even date with this application and which are assigned to the same assignee as this application. For a detailed description of the operation of the flash apparatus of FIG. 5, reference should be made to these co-pending applications.

Briefly, the correct exposure annunciator in FIG. 5 is formed by resistors R19, R20 and R21, zener diodes ZD5 and ZD6, diode D7, capacitor C11, transistor Q3, and indicator VR2. The correct exposure annunciator is connected to the anode of SCR1, and operates when SCR1 is turned off by commutation.

Remote sensor 40′ includes terminals 42 and 44, zener diode ZD7 and ZD8, light activated silicon controlled rectifier LASCR1, integration capacitor C10, anticipation resistor R18, diodes D8 and D9, a voltage divider formed by resistors R22, R23, and R24, capacitor C12, and transistor Q4. Terminal 42 receives the reference potential, and terminal 44 receives the signal line potential.

Zener diode ZD7 has its anode connected to terminal 42 and its cathode connected to the anode of LASCR1. The cathode of LASCR1 is connected to terminal 44. Integration capacitor C10 and anticipation resistor R18 are connected in series with resistor R24 between terminal 44 and the gate of LASCR1. Also connected to the gate of LASCR1 and to integration capacitor C10 is the anode of diode D8. The cathode of D8 is connected to the wiper arm of resistor R22. Resistor R23 is connected between the cathode of D8 and the junction of resistors R18 and R24.

Diode D9 and zener diode ZD8 are connected between terminal 44 and the anode of LASCR1. The anode of D9 is connected to terminal 44, and the cathode of D9 is connected to the anode of ZD8. The cathode of ZD8 is connected to the anode of LASCR1.

Transistor Q4 has its base electrode connected to the cathode of D9 and its collector - emitter current path connected in parallel with resistor R24. Capacitor C12 is also connected in parallel with resistor R24.

Because the cathode of LASCR1 is connected directly to terminal 44, LASCR1 will turn on when the gate voltage $V_g$ exceeds the signal line potential. When LASCR1 turns on, it causes a step change in the signal line potential toward the reference potential. This change is coupled through capacitor C7 to the gate of commutation switch SCR2, thereby turning on SCR2. The resulting commutation of SCR1 causes operation of the correct exposure annunciator.

The remote sensor 40′ of FIG. 5 achieves improved correct exposure indication in a manner somewhat similar to remote sensor 40 of FIG. 2. In FIG. 2, the reference voltage $V_{ref}$ was reduced when the signal line began to collapse. In FIG. 5, on the other hand, the gate voltage $V_g$ is increased by a predetermined amount when the signal line potential $V_{sig}$ begins to collapse. The components in FIG. 5 which produce the extended range of operation of the correct exposure annunciator are transistor Q4, resistors R23 and R24, capacitor C12, and diode D9.

Figure 6A:
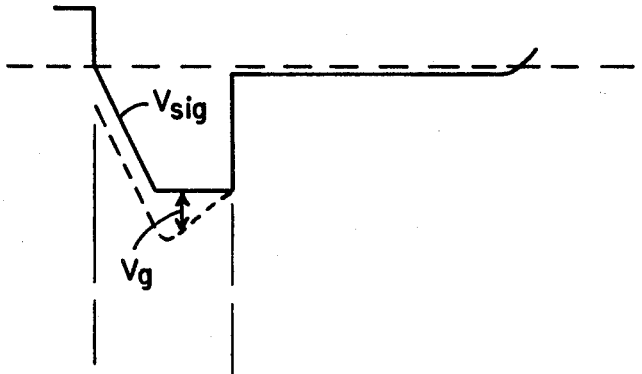
FIGS. 6A – 6c show signal line potential $V_{sig}$ and gate potential $V_g$ as a function of time for three different levels of illumination received by the remote sensor of FIG. 5.
Figure 6B:
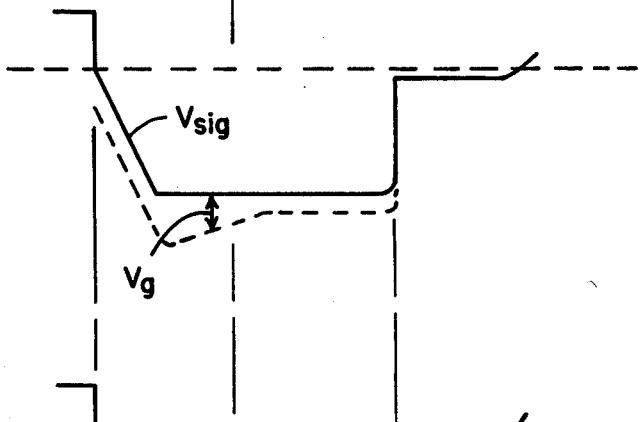
Figure 6C:
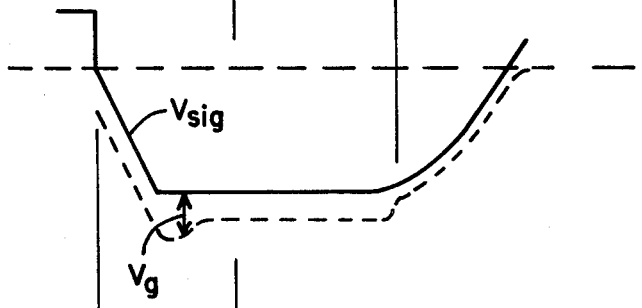
Figure 7:
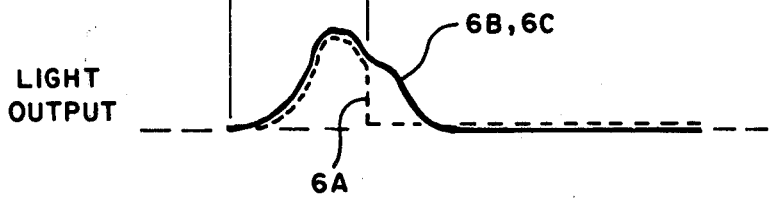
FIG. 7 shows light output as a function of time for the operating conditions shown in FIGS. 6A – 6C.

FIGS. 6A–6C and FIG. 7 further illustrate the operation of the apparatus of FIG. 5. FIG. 6A shows $V_{sig}$ and $V_g$ when sufficient light is received to terminate the flash prematurely. FIGS. 6B and 6C show $V_{sig}$ and $V_g$ in situations in which insufficient light is received to cause premature termination of the flash. FIG. 6B, the amount of light is sufficient to produce an acceptable photograph, while in FIG. 6C, the amount of light received is insufficient to produce an acceptable photograph. FIG. 7 shows light output as a function of time for the situations described in FIGS. 6A–6C.

The operation of the remote sensor is generally as follows. Capacitor C10 has been initially biased negatively by resistors R22, R23, R24, and diode D8. The gate voltage with respect to $V_{sig}$, $V_g$, is initially negative. When contacts S1 are closed, the signal line potential is driven negative with respect to the reference potential. This enables remote sensor 40′.

When the signal line potential $V_{sig}$ is at its negative level, transistor Q4 is turned on. As a result, Q4 essentially shorts out resistor R24. $V_g$, therefore is equal to the voltage across C10 plus R18.

In the situation shown in FIG. 6A, sufficient light is received during the flash interval to cause the gate voltage to exceed $V_{sig}$. When this occurs, LASCR1 turns on, causing a step change in the signal line potential $V_{sig}$. This step change turns on SCR2 and results in commutation of the flash and operation of the correct exposure annunciator. The dashed line in FIG. 7 illustrates the light output from the flash which has been prematurely terminated.

If flash tube FT1 extinguishes because the voltage on capacitor C1 can no longer maintain conduction (i.e. a "full light flash"), the signal line potential $V_{sig}$ begins to rise toward the reference potential. Q4 turns off and the voltage at the collector of Q4 rises to a voltage determined by the voltage divider formed by resistors R18 and R19. This effectively adds an additional voltage to $V_g$. If this increased gate voltage $V_g$ exceeds the signal line potential $V_{sig}$, LASCR1 fires. This results in a change in $V_{sig}$ as shown in FIG. 6B. This change causes commutation to occur and operation of the correct exposure annunciator.

If gate voltage $V_g$ including the added voltage is still insufficient to trigger LASCR1, then the correct exposure annunciator is not operated. This is the situation shown in FIG. 6C.

The embodiments of the present invention shown in FIGS. 1, 2 and 5 each provide improved range of performance of the correct exposure annunciator. The embodiments shown in FIGS. 2 and 5 have the advantage over FIG. 1 is that no separate calibration of the second predetermined level is required.

Other techniques for providing operation of the annunciator with a second predetermined level which is less than the first predetermined level are possible. For example, the remote sensor of FIG. 2 may be modified to produce an increase in $V_g$ when signal line potential begins to collapse rather than a reduction in $V_{ref}$. The additional voltage may be supplied in a manner similar to FIG. 5.

Figure 8:
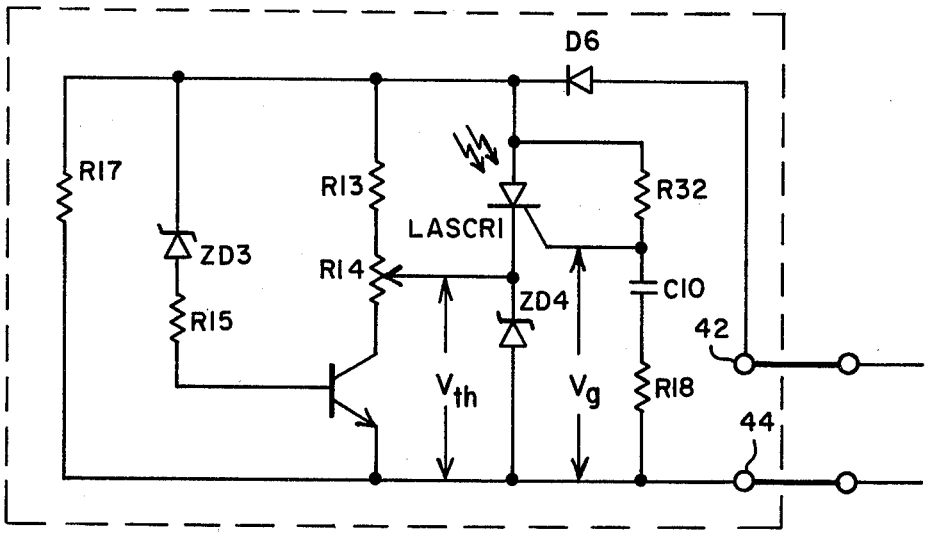
FIG. 8 shows another embodiment of a remote light sensor for use with electronic flash apparatus having improved operating characteristics of the correct exposure annunciator.

FIG. 8 shows another means of increasing $V_g$ after a full light flash. The remote sensor of FIG. 8 is substantially similar in operation to the remote sensor of FIG. 2, except that resistors R12 and R16 and transistor Q2 have been eliminated and resistor R32 has been added. Resistor R32 is connected between the anode and gate of LASCR1.

The remote sensor of FIG. 8 may be used, for example, to provide operation of the correct exposure annunciator to one-half f/stop below the full rated illumination. Since the remote sensor is typically powered for approximately 5 milliseconds and the flash is over 1.5 milliseconds, sufficient time exists after the flash to charge integration capacitor an additional 30 percent of $V_{th}$. By doing this, LASCR1 fires at 5 milliseconds if sufficient light was integrated to generate 70 percent of the voltage required to trigger LASCR1, because an additional 30 percent was added after the flash. The additional charge to capacitor C10 is provided by resistor R32. The value of R32 is selected so that the charging time constant for charging C10 will allow charging of C10 to 30 percent of the reference voltage in 5 milliseconds.

The remote sensor of FIG. 8 does provide improved range of operation of the correct exposure annunciator. In addition, it requires fewer components than the remote sensor of FIG. 2. The remote sensor of FIG. 8, however, has one shortcoming. Resistor R32 introduces some error into $V_g$ during the production of the light flash. While this is minimized by proper selection of the value of R32, the error, nonetheles, is present. The embodiments of the invention shown in FIGS. 1, 2, and 5, on the other hand, introduce no error into the control of premature termination while providing improved operation of the annunciator circuit. These previous embodiments, therefore, are generally preferred over the embodiment shown in FIG. 8.

In conclusion, improved operation of the correct exposure annunciator is electronic flash apparatus is achieved with the present invention. This is achieved by providing operation of the correct exposure indicator if the signal produced by the light sensor is within a predetermined percentage of the amount of light required to prematurely terminate the flash.

Although the present invention has been described with reference to a series of preferred embodiments, workers skilled in the art will recognize that changes may be made in form and detail without departing from the spirit and scope of the invention.

The embodiments of the invention in which an exclusive property or right is claimed are defined as follows:

1. Electronic flash apparatus comprising:

flash producing means;

triggering means for firing the flash producing means to produce light;

first means for providing a first signal in response to light received;

light terminating means for prematurely terminating the light from the flash producing means if the first signal attains a first predetermined level;

second means for causing a second signal to be produced if the first signal attains a second predetermined level; and annunciator means responsive to the second signal.

2. The electronic flash apparatus of claim 1 wherein the light terminating means includes switching means for switching from a first state to a second state when a switching threshold is attained by the first signal.

3. The electronic flash apparatus of claim 2 wherein the second signal is produced as a result of switching of the switching means from the first state to the second state.

4. The electronic flash apparatus of claim 3 wherein the switching threshold is the first predetermined level during the production of light.

5. The apparatus of claim 4 wherein the second means adds a predetermined signal to the first signal after termination of the light other than by the terminating means such that the first signal attains the first predetermined level if it has attained the second predetermined level.

6. The electronic flash apparatus of claim 4 wherein the second means reduces the switching threshold from the first predetermined level to the second predetermined level after termination of the light other than by the terminating means.

7. For use with an electronic flash unit having terminating means for prematurely terminating a light flash and having annunciator means, a light sensing means comprising:

first and second terminals for receiving a reference potential and a signal line potential, respectively, the signal line potential exhibiting a first change with respect to the reference potential when the electronic flash unit is selectively rendered operative;

first signal generating means for providing a first signal in response to light received;

first switching means for providing a second change in the signal line potential with respect to the reference potential when the first signal attains a switching threshold, the second change causing operation of the flash terminating means and the annunciator means; and annunciator range extending means for causing the switching means to provide the second change after termination of a light flash other than by the terminating means if the first signal has attained a level which is a predetermined percentage of the switching threshold.

8. The invention of claim 7 wherein the annunciator range extending means adds a signal to the first signal after termination of the light flash such that the first signal attains the switching threshold if it has attained the level which is a predetermined percentage of the switching threshold.

9. The invention of claim 7 wherein the annunciator range extending means decreases the switching threshold after termination of the light flash to a predetermined percentage of the switching threshold during the light flash.

10. The invention of claim 7 wherein the annunciator range extending means comprises second switching means for changing states in response to a change in signal line potential after termination of the light flash.

11. The invention of claim 10 wherein the change of states of the second switching means causes an effective increase in the first signal.

12. The invention of claim 10 wherein the change of states of the second switching means causes an effective decrease in the switching threshold.

13. The invention of claim 7 wherein the first signal generating means comprises:

light responsive means for producing a signal in response to light received thereby; and integrating means for providing a light integral signal which forms at least a part of the first signal.

14. The invention of claim 13 wherein the first switching means has a control electrode and first and second main current carrying electrodes.

15. The invention of claim 14 wherein the control electrode of the first switching means is connected to the integrating means.

16. The invention of claim 15 wherein the second main current carrying electrode is connected to the second terminal.

17. The invention of claim 16 wherein the annunciator range extending means causes an effective increase in the magnitude of the first signal after termination of the light flash.

18. The invention of claim 15 and further comprising threshold means for applying a threshold signal to the second main current carrying electrode.

19. The invention of claim 18 wherein the annunciator range extending means causes an effective decrease in the threshold signal after termination of the light flash.

20. Electronic flash apparatus comprising:

flash producing means;

triggering means for firing the flash producing means to produce light;

first means for providing a first signal in response to light received;

light terminating means for prematurely terminating the light from the flash producing means if the first signal attains a first predetermined level; and annunciator means operable if the first signal attains a second predetermined level different from the first predetermined level.

* * * * *